US009724816B2

(12) United States Patent
Hecht et al.

(10) Patent No.: US 9,724,816 B2
(45) Date of Patent: Aug. 8, 2017

(54) HAND-HELD ELECTRIC TOOL HAVING A SPINDLE-LOCKING DEVICE

(75) Inventors: Joachim Hecht, Magstadt (DE); Martin Kraus, Filderstadt (DE)

(73) Assignee: ROBERT BOSCH GmbH, Stuttgart (DE)

( * ) Notice: Subject to any disclaimer, the term of this patent is extended or adjusted under 35 U.S.C. 154(b) by 901 days.

(21) Appl. No.: 13/879,547

(22) PCT Filed: Sep. 28, 2011

(86) PCT No.: PCT/EP2011/066897

§ 371 (c)(1),
(2), (4) Date: Jul. 2, 2013

(87) PCT Pub. No.: WO2012/049024

PCT Pub. Date: Apr. 19, 2012

(65) Prior Publication Data

US 2013/0270051 A1 Oct. 17, 2013

(30) Foreign Application Priority Data

Oct. 15, 2010 (DE) ..... 10 2010 042 497
Mar. 15, 2011 (DE) ..... 10 2011 005 553

(51) Int. Cl.
*B25F 5/00* (2006.01)
*B25B 21/00* (2006.01)
*B25F 5/02* (2006.01)

(52) U.S. Cl.
CPC ..... *B25F 5/001* (2013.01); *B25B 21/00* (2013.01); *B25F 5/02* (2013.01)

(58) Field of Classification Search
CPC ... B25D 5/001; B25F 5/02; B25F 1/02; B25F 3/00; B25F 5/00; B25F 5/001
(Continued)

(56) References Cited

U.S. PATENT DOCUMENTS 2,900,844 A * 8/1959 Kalilec ..... B23B 45/008 144/1.1
3,021,723 A * 2/1962 Happe ..... B23Q 11/0092 188/69
(Continued)

FOREIGN PATENT DOCUMENTS

CA 2135947 A1 * 9/1996 ..... B25B 21/00
CH GB 2327254 A * 1/1999 ..... B25B 21/00
(Continued)

OTHER PUBLICATIONS

International Search Report, International Application No. PCT/EP2011/066897, dated Jun. 8, 2012.

*Primary Examiner* — Gloria R Weeks
*Assistant Examiner* — Lucas Palmer
(74) *Attorney, Agent, or Firm* — Norton Rose Fulbright US LLP; Gerard Messina

(57) ABSTRACT

In a handheld electric tool having a tool housing in which is disposed a gearbox for transferring a torque, generated by a drive motor, to a drive spindle with which a spindle locking apparatus is associated, the drive spindle being rotatably mounted in the tool housing at at least two bearing points, the at least two bearing points are provided in the tool housing in a region downstream from the gearbox, and the spindle locking apparatus is disposed between the two bearing points in an axial direction of the drive spindle.

20 Claims, 12 Drawing Sheets

(58) Field of Classification Search
USPC ..... 173/216
See application file for complete search history.

(56) References Cited

U.S. PATENT DOCUMENTS 3,243,023 A * 3/1966 Boyden ..... F16B 1/04 192/223.2
3,777,825 A * 12/1973 Gullich ..... B25D 16/00 173/109
3,872,951 A * 3/1975 Hastings, Jr. ..... B23Q 5/20 188/69
4,209,182 A * 6/1980 Sheldon ..... B23B 31/1071 279/30
4,400,995 A * 8/1983 Palm ..... B23B 45/008 173/164
4,823,627 A * 4/1989 Mills ..... F16H 29/04 74/117
4,923,047 A * 5/1990 Fink ..... B25B 23/147 192/150
5,016,501 A * 5/1991 Holzer, Jr. ..... B25B 21/00 173/181
5,271,486 A * 12/1993 Okamoto ..... F16D 41/064 192/45.016
5,355,748 A * 10/1994 Ito ..... B60K 17/3505 180/248
5,496,139 A * 3/1996 Ghode ..... B25F 5/001 188/69
5,697,158 A * 12/1997 Klinzing ..... A61B 17/14 30/166.3
5,947,254 A * 9/1999 Jones ..... B25F 5/001 192/223.2
6,273,200 B1 * 8/2001 Smith ..... B25B 21/00 173/216
6,311,787 B1 * 11/2001 Berry ..... B25F 5/001 173/176
6,497,316 B1 * 12/2002 Hsu ..... B25B 21/00 173/178
6,506,002 B1 * 1/2003 Cummins ..... B23B 39/205 408/124
6,513,604 B2 * 2/2003 Hanke ..... B25D 17/088 173/104
6,702,090 B2 * 3/2004 Nakamura ..... B25F 5/001 173/217
7,073,606 B2 * 7/2006 Mamber ..... B23B 31/123 173/216
7,131,503 B2 * 11/2006 Furuta ..... B25B 21/00 173/104
7,395,874 B2 * 7/2008 Zeiter ..... B25F 5/001 173/176
7,455,574 B2 * 11/2008 Chu ..... B25F 5/001 192/223.2
7,717,191 B2 * 5/2010 Trautner ..... B25D 11/106 173/117
7,717,192 B2 * 5/2010 Schroeder ..... B25D 16/006 173/104
7,798,245 B2 * 9/2010 Trautner ..... B23B 45/008 173/117
7,806,199 B2 * 10/2010 Pohl ..... B25D 16/006 173/171
7,854,274 B2 * 12/2010 Trautner ..... B25D 16/006 173/117
7,963,195 B2 * 6/2011 McRoberts ..... B25B 13/465 81/54
7,980,325 B2 * 7/2011 Botefuhr ..... B24B 23/022 173/213
8,011,444 B2 * 9/2011 Pyles ..... B23Q 5/20 173/164
9,168,651 B2 * 10/2015 Hecht ..... B25F 5/001
2004/0231952 A1 * 11/2004 Nakamura ..... B25F 5/001 192/223
2006/0147283 A1 * 7/2006 Phillips ..... B23B 45/003 408/35
2007/0205077 A1 * 9/2007 Nakamura ..... B25F 5/001 192/116.5
2008/0142237 A1 * 6/2008 Fuchs ..... B23B 39/14 173/104
2008/0196555 A1 * 8/2008 Yoon ..... B25B 21/02 81/57.11
2008/0302550 A1 * 12/2008 Erhardt ..... B25B 21/00 173/216
2009/0003949 A1 * 1/2009 Mok ..... B23B 31/123 408/240
2010/0163261 A1 * 7/2010 Tomayko ..... B23B 45/008 173/47
2010/0200257 A1 * 8/2010 Scrimshaw ..... B23B 31/1238 173/47
2011/0220380 A1 9/2011 Roehm
2011/0232930 A1 * 9/2011 Zhang ..... B25F 5/001 173/178
2011/0303432 A1 * 12/2011 Stauffer ..... B25F 5/02 173/181
2012/0006575 A1 * 1/2012 Hecht ..... B25B 21/00 173/216
2013/0269117 A1 * 10/2013 Wilkinson ..... B25B 15/02 7/167
2014/0238711 A1 * 8/2014 Myhill ..... B25F 5/001 173/1

FOREIGN PATENT DOCUMENTS

DE 32 34 254 4/1983
DE EP 0720888 A1 * 7/1996 ..... B23Q 3/12
DE 10 2007 000 313 12/2008
DE EP 2008773 A1 * 12/2008 ..... B25F 5/001
DE WO 2010034565 A1 * 4/2010 ..... B25F 5/001
EP 0792723 A2 9/1997
EP 2008773 A1 12/2008
GB 2327254 A 1/1999
JP 2002337062 A * 11/2002
WO 0178948 A1 10/2001
WO WO 2010/034565 4/2010

* cited by examiner

HAND-HELD ELECTRIC TOOL HAVING A SPINDLE-LOCKING DEVICE

FIELD

The present invention relates to a handheld electric tool having a tool housing in which is disposed a gearbox for transferring a torque, generated by a drive motor, to a drive spindle with which a spindle locking apparatus is associated, the drive spindle being rotatably mounted in the tool housing at least two bearing points.

BACKGROUND INFORMATION

Handheld electric tools in which a drive spindle equipped with a spindle locking apparatus is mounted in a tool housing at two bearing points, are conventional. The spindle locking apparatus is disposed either in a region downstream from the two bearing points in an axial direction of the drive spindle, or in one plane with a first of the two bearing points that is disposed on or in the gearbox.

A disadvantageous aspect is that electric tools in which the spindle locking apparatus is disposed in a region downstream from the two bearing points in an axial direction of the drive spindle have a comparatively large overall length in an axial direction of the drive spindle. On the other hand, in electric tools in which the spindle locking apparatus is disposed in one plane with a first bearing point that is disposed on or in the gearbox, the drive spindle exhibits a comparatively large tilting clearance.

SUMMARY

An object of the present invention is to make available a handheld electric tool having a spindle locking apparatus that makes possible a shortened overall length of the electric tool simultaneously with a reduction in the tilting clearance of its drive spindle. A further object of the present invention is to make available a novel handheld electric tool, having a drive spindle as well as a spindle locking apparatus, in the operation of which an undesired noise emission occurring in the context of a runout of the drive spindle can be at least reduced.

In accordance with the present invention, an example handheld electric tool is provided having a tool housing in which is disposed a gearbox for transferring a torque, generated by a drive motor, to a drive spindle with which a spindle locking apparatus is associated. The drive spindle is rotatably mounted in the tool housing at least two bearing points. The at least two bearing points are provided in the tool housing in a region downstream from the gearbox. The spindle locking apparatus is disposed between the two bearing points in an axial direction of the drive spindle.

The present invention thus makes it possible to furnish a handheld electric tool in which a shortening of the overall length in an axial direction of the drive spindle is made possible by a placement of the spindle locking apparatus between the two bearing points.

According to an example embodiment, the spindle locking apparatus has a carrier element, mounted on the drive spindle with a predefined radial clearance, on which at least one spindle roller is disposed.

Stable and reliable mounting of the spindle rollers on the drive spindle can thereby be enabled.

The at least one spindle roller abuts against the drive spindle preferably directly between the two bearing points in an axial direction of the drive spindle.

A reduction in the tilting clearance of the drive spindle can thereby be achieved in simple fashion.

According to an example embodiment, the carrier element is mounted at a first of the at least two bearing points, by way of a bearing ring embodied on its outer periphery, in a plain bearing.

The present invention thereby enables effective and economical mounting of the carrier element in the electric tool.

The plain bearing is preferably mounted in a blocking member which is embodied to prevent the at least one spindle roller from sliding out of the carrier element in a radial direction of the drive spindle.

The spindle rollers can thereby be securely and reliably immobilized in the carrier element.

According to an example embodiment, the drive spindle is mounted, at a first of the at least two bearing points, in a rolling bearing.

The present invention thereby enables stable and comparatively wear-free mounting of the drive spindle in the electric tool.

The rolling bearing is preferably mounted in a blocking member which is embodied to prevent the at least one spindle roller from sliding out of the carrier element in a radial direction of the drive spindle.

The spindle rollers can thereby be securely and reliably immobilized in the carrier element.

The blocking member is preferably embodied annularly and is connected nonrotatably to the tool housing.

The blocking member can thereby be immobilized in simple fashion in the tool housing.

The drive spindle is preferably mounted, at a second of the at least two bearing points, in a rolling bearing that is mounted in the tool housing.

The drive spindle can thereby be mounted in stable and comparatively wear-free fashion in the electric tool.

According to an embodiment, the carrier element is of sleeve-shaped configuration and surrounds the drive spindle at least in portions, at least one recess for receiving the at least one spindle roller being embodied on the carrier element.

The present invention thus makes it possible to furnish a simple and economical carrier element on which the spindle rollers can be securely and reliably mounted.

The carrier element is preferably connected nonrotatably to a drive member of the gearbox.

A shortening of the overall length in an axial direction of the drive spindle can thereby be enabled in simple fashion.

According to an example embodiment, the gearbox is embodied as a planetary gearbox, and the drive member is a planet carrier.

The present invention thereby enables provision of a secure and reliable gearbox.

The drive spindle is preferably drivable directly by the drive member, a predefined radial clearance being embodied between the drive member and the drive spindle.

The drive spindle can thereby be driven in simple fashion.

According to an example embodiment, the drive spindle is drivable directly by the carrier element.

The present invention thereby makes possible an improvement in the interaction of the carrier element, drive spindle, and drive member.

According to an example embodiment, a bearing ring that is mounted in an associated plain bearing is nonrotatably disposed on the drive spindle in the region of a first of the at least two bearing points.

The use of a plain bearing at the first bearing point can thereby be enabled in simple fashion.

The problem described initially may also be solved by an example handheld electric tool having a tool housing in which is disposed a gearbox for transferring a torque, generated by a drive motor, to a drive spindle with which a spindle locking apparatus is associated, the drive spindle being rotatably mounted in the tool housing at least two bearing points. A brake apparatus which is embodied to prevent chattering during operation of the electric tool in the context of a runout of the drive spindle is provided on the drive spindle in the region of the spindle locking apparatus.

The present invention thereby makes it possible to furnish a handheld electric tool in which, as a result of the provision of a brake apparatus disposed in the region of the spindle locking apparatus, undesired noise emission from the drive spindle in the context of runout can be securely and reliably at least reduced.

The brake apparatus preferably has an O-ring to implement a braking function.

A simple and economical brake apparatus can thereby be made available.

An annular groove in which the O-ring is disposed is preferably embodied on the drive spindle in the region of the spindle locking apparatus.

An uncomplicated and robust brake apparatus can thereby be made available.

According to an example embodiment, the spindle locking apparatus has a carrier element mounted on the drive spindle with a predefined radial clearance. The brake apparatus is disposed in the region of the carrier element.

The present invention thereby makes possible the provision of a handheld electric tool having a simple and stable spindle locking apparatus.

The carrier element is preferably connected nonrotatably to a drive member of the gearbox.

A shortening of the overall length in an axial direction of the drive spindle can thereby be enabled in simple fashion.

The drive spindle is preferably drivable directly by the carrier element.

The present invention thereby makes possible an improvement in the interaction of the carrier element, drive spindle, and drive member.

According to an example embodiment, at least one spindle roller is disposed on the carrier element.

The present invention thereby makes possible the provision of a spindle locking apparatus in which stable and reliable mounting of the spindle rollers on the drive spindle can be enabled.

The at least one spindle roller abuts against the drive spindle preferably directly between the two bearing points in an axial direction of the drive spindle.

A reduction in the tilting clearance of the drive spindle can thus be achieved in simple fashion.

The carrier element is preferably mounted, by way of a bearing ring embodied on its outer periphery, in a plain bearing at a first of the at least two bearing points.

Effective and economical mounting of the carrier element in the electric tool can thereby be enabled.

The plain bearing is preferably mounted in a blocking member which is embodied to prevent the at least one spindle roller from sliding out of the carrier element in a radial direction of the drive spindle.

The spindle rollers can thereby be immobilized securely and reliably in the carrier element.

Preferably the at least two bearing points are provided in the tool housing in a region downstream from the gearbox, and the spindle locking apparatus is disposed between the two bearing points in an axial direction of the drive spindle.

A shortening of the overall length in an axial direction of the drive spindle can thereby be achieved by placement of the spindle locking apparatus between the two bearing points.

BRIEF DESCRIPTION OF THE DRAWINGS

The present invention is explained in the description below with reference to exemplifying embodiments depicted in the figures.

DETAILED DESCRIPTION OF EXAMPLE EMBODIMENTS

Figure 1:
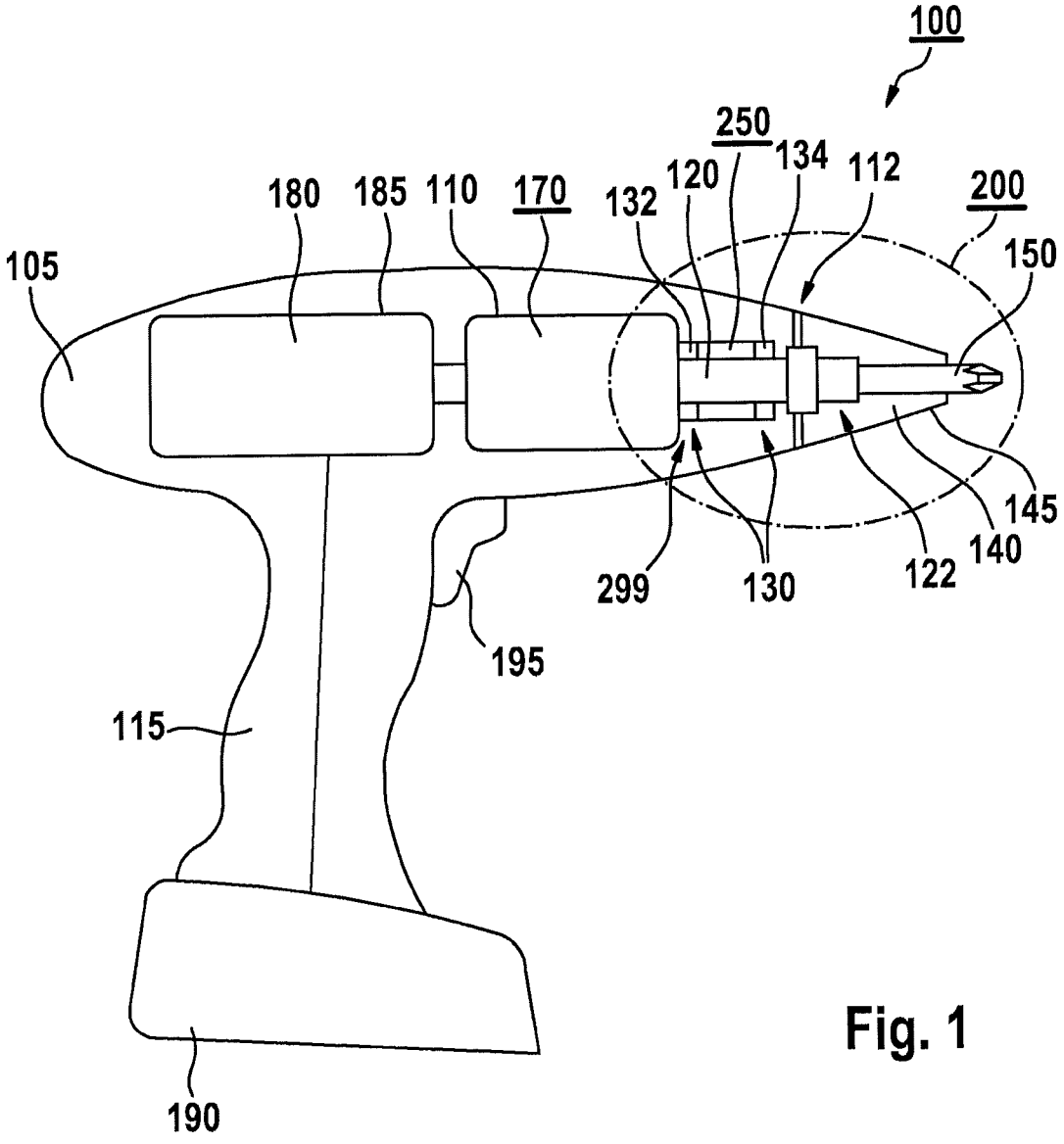
FIG. 1 is a schematic view of an example handheld electric tool in accordance with the present invention.

FIG. 1 shows a handheld electric tool 100 that has a tool housing 105 having a handle 115. According to an example embodiment, electric tool 100 is mechanically and electrically connectable to a rechargeable battery pack 190 for cordless power supply. Electric tool 100 is embodied in FIG. 1, by way of example, as a battery-operated drill driver. However, that the present invention is not confined to battery-operated drill drivers, but instead can be utilized for a variety of, in particular, rechargeable-battery-driven electric tools in which a tool is caused to rotate, for example a battery-operated screwdriver, battery-operated impact drill driver, etc.

A drive motor 180 supplied with power from rechargeable battery pack 190, and a gearbox 170, are disposed in housing 105. Drive motor 180 is connected via gearbox 170 to a drive shaft 120, for example a drive spindle. Drive motor 180 is disposed illustratively in a motor housing 185, and gearbox 170 is a gearbox housing 110; by way of example, gearbox housing 110 and motor housing 185 are disposed in housing 105.

Gearbox 170 is embodied to transfer to drive spindle 120 a torque generated by drive motor 180, and according to an embodiment is a planetary gearbox, embodied with a variety of gear stages or planetary stages, that is rotationally driven by drive motor 180 during the operation of electric tool 100. Planetary gearbox 170 is described below with reference to a sectioned view, depicted in enlarged fashion in FIG. 2, of a portion 200.

Drive motor 180 is actuable, i.e., switchable on and off, for example by way of a manual switch 195, and can be any type of motor, e.g., an electronically commutated motor or a DC motor. Drive motor 180 is preferably electronically controllable in open- or closed-loop fashion in such a way that both reverse operation and stipulations with regard to a desired rotation speed can be implemented. The configuration and manner of operation of a suitable drive motor are conventional, so that an exhaustive description will be dispensed with here in the interest of conciseness.

Drive spindle 120 is mounted in housing 105 rotatably by way of a bearing assemblage 130, and is equipped with a tool receptacle 140 that is disposed in the region of an end face 112 of housing 105 and has, for example, a drill chuck 145. According to an example embodiment, bearing assemblage 130 has at least two bearing points 132, 134 that are provided in tool housing 105 in a region 299 downstream from gearbox 170. Associated bearings (e.g. 232, 234 in FIG. 2), which serve as spindle bearings and in which drive spindle 120 is mounted, are disposed at bearing points 132, 134. Tool receptacle 140 serves to receive a tool 150, and can be shaped onto drive spindle 120 or connected thereto in the form of an attachment. In FIG. 1, tool receptacle 140 is embodied by way of example as an attachment, and is fastened onto tool spindle 120 by way of a fastening apparatus 122 provided thereon.

According to an example embodiment, drive spindle 120 has a spindle locking apparatus 250 associated with it. The latter is disposed, preferably directly, between the two bearing points 132, 134 in an axial direction of drive spindle 120, and serves to center drive spindle 120 when drive motor 180 is switched off. The manner of operation of spindle locking apparatuses is conventional, so that an exhaustive description of the manner of operation of spindle locking apparatus 250 will be dispensed with here in the interest of conciseness.

Figure 2:
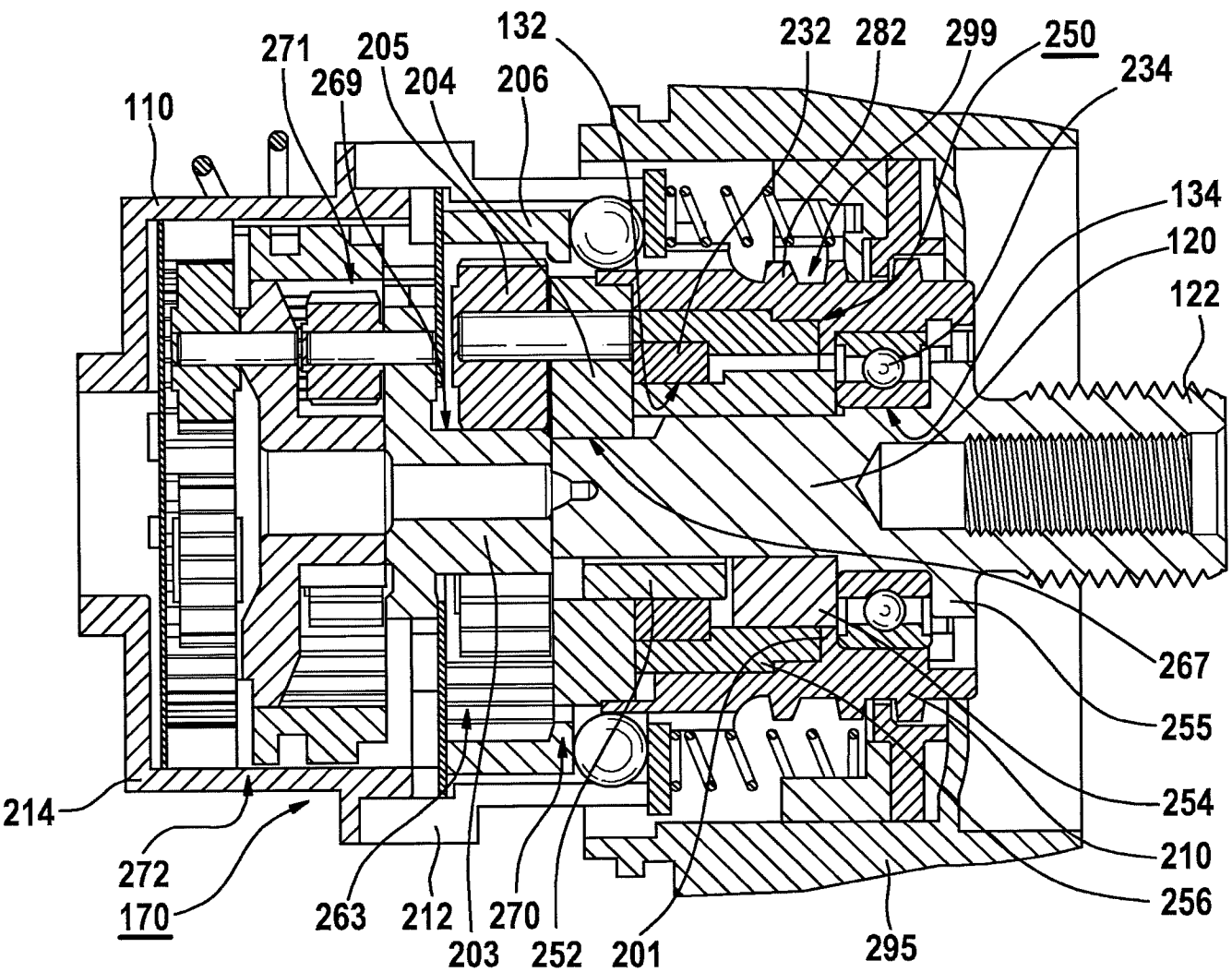
FIG. 2 is an enlarged side view of a portion of the electric tool of FIG. 1, according to a first embodiment.

FIG. 2 shows portion 200 of handheld electric tool 100 of FIG. 1, in which a depiction of tool 150 and tool receptacle 140 of FIG. 1 has been omitted in the interest of graphic clarity and simplicity. Portion 200 illustrates an exemplifying configuration of planetary gearbox 170, drive spindle 120, bearing assemblage 130, and of spindle locking apparatus 250 according to a first embodiment.

Planetary gearbox 170 has, for example, three gear stages or planetary stages: a front stage 270, a middle stage 271, and a rear stage 272. Front planetary stage 270 has, for example, a sun wheel 203 having a tooth set 269, at least one planet wheel 205 having a tooth set 263, a planet carrier 204 having a rotational entrainment contour 267, and a ring gear 206.

The torque of drive motor 180 of FIG. 1 is transferred via planetary stages 272, 271, 270, by way of rotational entrainment contour 267 of planet carrier 204, to drive spindle 120. Planet carrier 204 serves here as a drive member for rotationally driving drive spindle 120. Because the construction of a planetary gearbox is conventional, a further description of planetary stages 271, 272 is dispensed with here in the interest of conciseness.

Planetary stages 270, 271, 272 are disposed illustratively in gearbox housing 110, which, by way of example, is embodied in three parts and has a front part 210, a middle part 212, and a back part 214. Front part 210 has, illustratively, an external thread 282 on which, by way of example, an adjusting ring 295 is rotatably mounted. An annular shoulder 201 is embodied, by way of example, on the inner periphery of front part 210.

Drive spindle 120 has fastening apparatus 122, embodied illustratively as an external thread, on which drill chuck 145 of tool receptacle 140 of FIG. 1 is fastenable; external thread 122 can be brought into threaded engagement, for example, with an internal thread provided on drill chuck 145.

In addition, a bracing flange 255 is, by way of example, provided on drive spindle 120.

Bearing assemblage 130 has, illustratively, a plain bearing 232, e.g., a sintered bearing, and a rolling bearing 234, e.g., a ball bearing. Sintered bearing 232 is, by way of example, disposed at bearing point 132 (hereinafter also referred to as the "first bearing point"), which is located preferably immediately downstream from planet carrier 204, and thus from gearbox 170, when viewed in the direction of tool receptacle 140 of FIG. 1. Ball bearing 234 is disposed, by way of example, at bearing point 134 (hereinafter also referred to as the "second bearing point"), which is spaced away from planet carrier 204 and thus from gearbox 170 when viewed in the direction of tool receptacle 140 of FIG. 1, and is braced against bracing flange 255.

According to an example embodiment, spindle locking apparatus 250 has a carrier element 252, mounted on drive spindle 120 with a predefined radial clearance, on which at least one spindle roller 254 is disposed. The latter abuts against drive spindle 120 between the two bearing points 132, 134 when viewed in an axial direction of drive spindle 120, preferably directly between sintered bearing 232 and ball bearing 234. Alternatively thereto, spindle roller 254 can abut, for example, against an inner ring of ball bearing 234. Sintered bearing 232 and the at least one spindle roller 254 are mounted in a blocking member 256 that is likewise associated with spindle locking apparatus 250 and is embodied to prevent the at least one spindle roller 254 from sliding out of carrier element 252 in a radial direction of drive spindle 120.

Blocking member 256 is embodied, for example, annularly, and is nonrotatably connected at least indirectly to tool housing 105. Illustratively, blocking member 256 is pressed nonrotatably into front part 210 of gearbox housing 110; a corresponding clearance can be present within predefined tolerances in both an axial and a radial direction. Alternatively thereto, blocking member 256 can be connected in zero-clearance fashion to gearbox housing 110. For example, blocking member 256 can be embodied integrally with gearbox housing 110 or can be shaped thereonto, for example by plastic injection molding.

Figure 3:
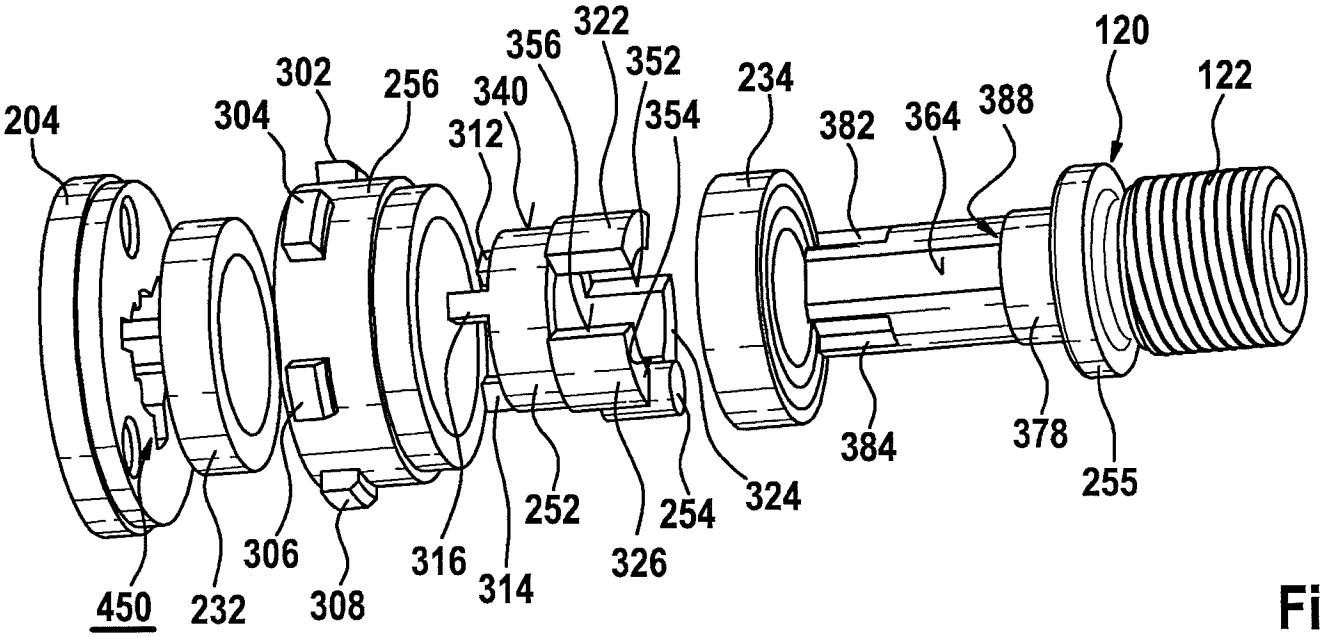
FIG. 3 is a perspective exploded depiction of the drive spindle, the drive member, the sintered bearing, the ball bearing, and the spindle locking apparatus of FIG. 2.

FIG. 3 shows planet carrier 204, sintered bearing 232, blocking member 256, carrier element 252, spindle roller 254, ball bearing 234, and drive spindle 120 of FIG. 2. As described above, blocking member 256, carrier element 252, and spindle roller 254 constitute the spindle locking apparatus 250 of FIG. 2 that is connected to drive spindle 120.

According to an example embodiment, drive spindle 120 has, on a side of bracing flange 255 facing away from external thread 122, an annular bearing structure 378 that terminates illustratively in an annular shoulder 388. Proceeding from annular shoulder 388 in the direction of that axial end of drive spindle 120 which is located opposite external thread 122, said spindle has one or more flattened lateral surfaces 364 that preferably correspond in number to the number of spindle rollers 254. In addition, groove-like recesses 382, 384 are embodied at that axial end of drive spindle 120 which is located opposite external thread 122.

Carrier element 252 is, illustratively, embodied in a sleeve shape and has on its outer periphery a bearing ring 340 that is embodied preferably integrally with carrier element 252 or at least shaped onto it. Provided at an axial end of bearing ring 340 are axial enlargements 322, 324, 326 that likewise extend radially outward beyond an outer periphery constituted by the bearing ring. Bolt-like retention members 312, 314, 316 for immobilizing carrier element 252 on planet carrier 204 are provided at the other axial end of bearing ring 340.

The axial and radial enlargements 322, 324, 326 constitute recesses 352, 354, 356 for receiving associated spindle rollers. Illustratively, spindle roller 254 is provided for reception in recess 354. However, any number of recesses for receiving any number of spindle rollers can be provided.

Blocking member 256 has, illustratively, a plurality of radially outwardly directed projections 302, 304, 306, 308. These serve for nonrotatable immobilization of blocking member 256 in front part 210 of gearbox housing 110 of FIG. 2, as described below with reference to FIG. 6.

Planet carrier 204 has, by way of example, a retention and entrainment apparatus 450 embodied at an approximately central opening. Said apparatus implements, for example, rotational entrainment contour 267 of FIG. 2, and is described in detail below with reference to FIG. 4.

An exemplifying assembly operation of sintered bearing 232, blocking member 256, carrier element 252, spindle roller 254, ball bearing 234, and drive spindle 120 onto planet carrier 204 or into front part 210 of gearbox housing 110 of FIG. 2 will be described below. Firstly ball bearing 234 is pressed onto the annular bearing structure 378 on drive spindle 120 and then, with the latter, is pressed into an opening, facing toward external thread 122 in FIG. 2, of front part 210 until ball bearing 234 abuts against annular shoulder 201 of FIG. 2. Blocking member 256 is then, proceeding from that axial end of drive spindle 120 which is located opposite external thread 122, slid in an axial direction onto said spindle and pressed into front part 210 in such a way that by way of the latter's radial projections 302, 304, 306, 308, a nonrotatable connection with front part 210 is generated.

Carrier element 252, with spindle rollers 254 disposed in its recesses 352, 354, 356, is then slid onto drive spindle 120 and thus into blocking member 256, so that carrier element 252 surrounds drive spindle 120 at least in portions, and spindle roller 254 abuts against that side of annular shoulder 201 of FIG. 2 which faces away from ball bearing 234. To achieve the smallest possible tilting clearance of drive spindle 120 in this context, a radial clearance that is possible between spindle 120 and carrier element 252 is preferably very small. The connection between spindle 120 and carrier element 252 is preferably zero-clearance. In addition, spindle roller 254 abuts against flattened lateral surface 364 of drive spindle 120.

Sintered bearing 232 is then slid onto bearing ring 340 of carrier element 252, and the latter's bolt-like retention members 312, 314, 316 and drive spindle 120 are anchored in retention and entrainment apparatus 450 of planet carrier 204 in such a way that at least drive spindle 120 is mounted on planet carrier 204 by way of a positive engagement having radial clearance. Spindle roller 254 is thereby disposed, as described above, preferably directly between sintered bearing 232 and ball bearing 234.

Figure 4:
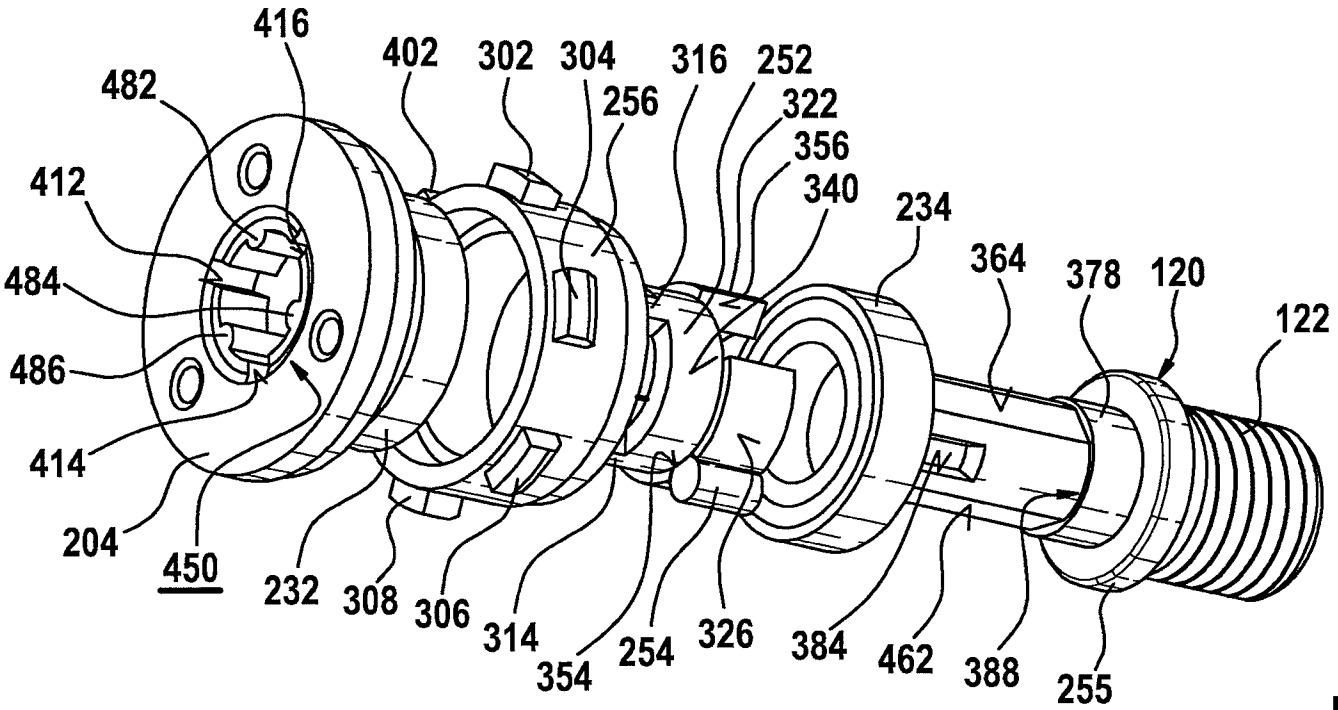
FIG. 4 shows the perspective exploded depiction of FIG. 3 seen from a different viewing angle.

FIG. 4 shows planet carrier 204, sintered bearing 232, blocking member 256, carrier element 252, spindle roller 254, ball bearing 234, and drive spindle 120 of FIG. 3. FIG. 4 illustrates an exemplifying second flattened lateral surface 462 on drive spindle 120, as well as a further radial projection 402 on blocking member 256.

According to an embodiment, retention and entrainment apparatus 450 of planet carrier 204 has retention grooves 412, 414, 416 and entrainment ridges 482, 484, 486. Retention grooves 412, 414, 416 serve, in the context of the assembly operation described in FIG. 3, for preferably zero-clearance reception of the respective bolt-like retention members 312, 314, 316 of carrier element 252. Entrainment ridges 482, 484, 486 are embodied to engage, in the context of the assembly operation described in FIG. 3, into the groove-like recesses 382, 384 of drive spindle 120 with a radial clearance defined within suitable tolerances, so as thereby to enable drive spindle to be directly rotationally driven by planet carrier 204.

However, the embodiment illustrated in FIGS. 2 to 4 is merely exemplifying in nature, and is not to be understood as a limitation of the present invention. Rather, numerous modifications of one or more components are possible in the context of the present invention. For example, carrier element 252 can perform a bearing function with respect to blocking member 256 at first bearing point 132, so that sintered bearing 232 can be omitted. In an alternative approach, carrier element 252 can be made shorter than depicted, so that sintered bearing 232 can be pressed directly into front part 210 of gearbox housing 110. Furthermore, blocking member 256 can be, for example, positively overmolded with plastic in front part 210, so that the overmolded blocking member 256 serves, instead of annular shoulder 201, as an abutment surface for ball bearing 234. In addition, for example, planet carrier 204 and carrier element 252 can be embodied integrally, or carrier element 252 can be shaped onto planet carrier 204 or, for example, fastened thereonto by welding or adhesive bonding, as shown by way of example in FIG. 15.

Figure 5:
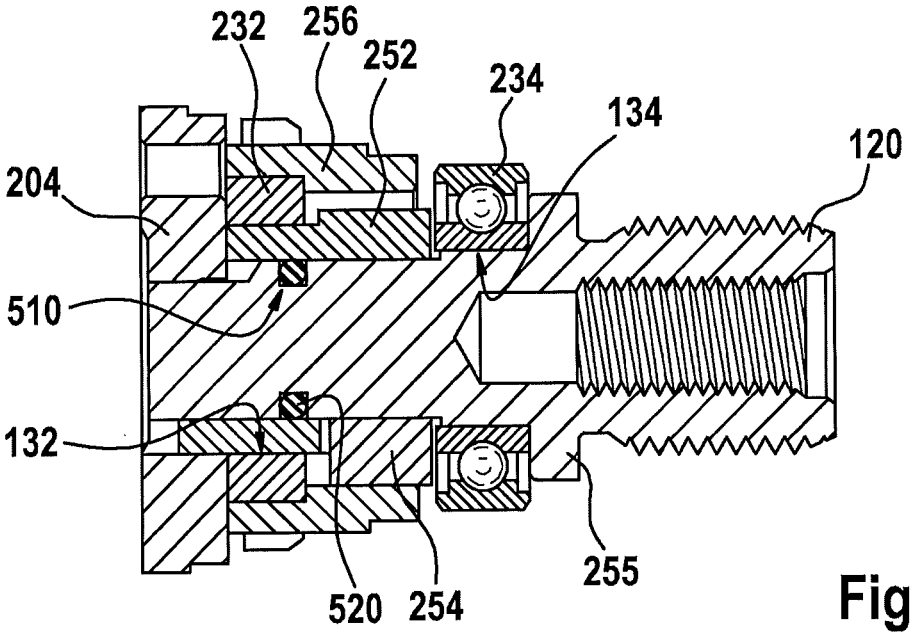
FIG. 5 shows the sectioned view of FIG. 2 with a modified drive spindle.

FIG. 5 shows the assemblage of FIGS. 3 and 4 after the assembly operation described in FIG. 3. In FIG. 5 drive spindle 120 has in the region of carrier element 252, illustratively, an annular groove 510 in which, for example, an O-ring 520 is disposed. The latter implements a braking function between carrier element 252 and drive spindle 120, so as thereby to prevent rattling in the context of a runout of drive spindle 120 during the operation of electric tool 100 of FIG. 1.

Figure 6:
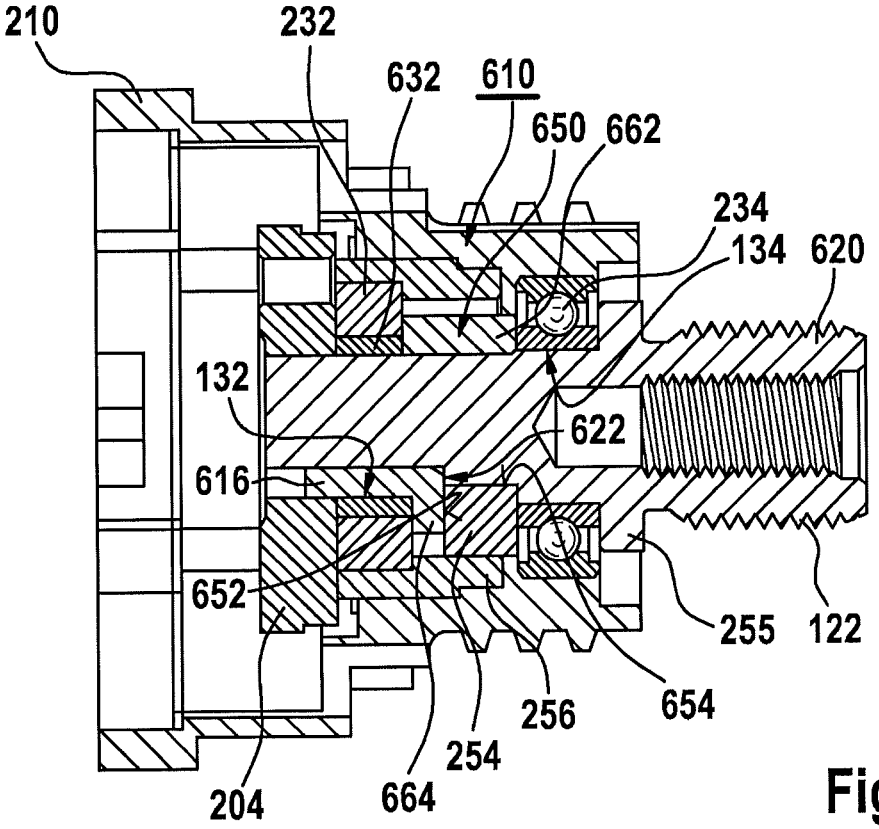
FIG. 6 is an enlarged sectioned view of the portion of the electric tool of FIG. 1, according to a second embodiment.

FIG. 6 shows planet carrier 204, sintered bearing 232, ball bearing 234 of FIGS. 2 to 4, and a drive spindle 620, as well as blocking member 256 of FIGS. 2 to 4, a carrier element 650, a bearing ring 632, and spindle roller 254 of FIGS. 2 to 4, which constitute a spindle locking apparatus 610 according to a further embodiment and are disposed in front part 210 of FIG. 2. Carrier element 650 has, illustratively, an annular collar 664 on which are embodied in one axial direction a bolt-like retention member 616 and in the opposite axial direction at least one recess 652 for the reception of spindle roller 254, as well as an axial enlargement 662.

Drive spindle 620 is shortened as compared with drive spindle 120 of FIGS. 2 to 5, and has at least one flattened lateral surface 654 that transitions, in an axial direction directed away from bracing flange 255, into a groove-like recess 622. The latter serves to receive bolt-like retention member 616 of carrier element 650. A bearing ring 632 is disposed on, preferably pressed onto, drive spindle 620 in the region of this bolt-like retention member 616. Said ring is mounted in sintered bearing 232.

Figure 7:
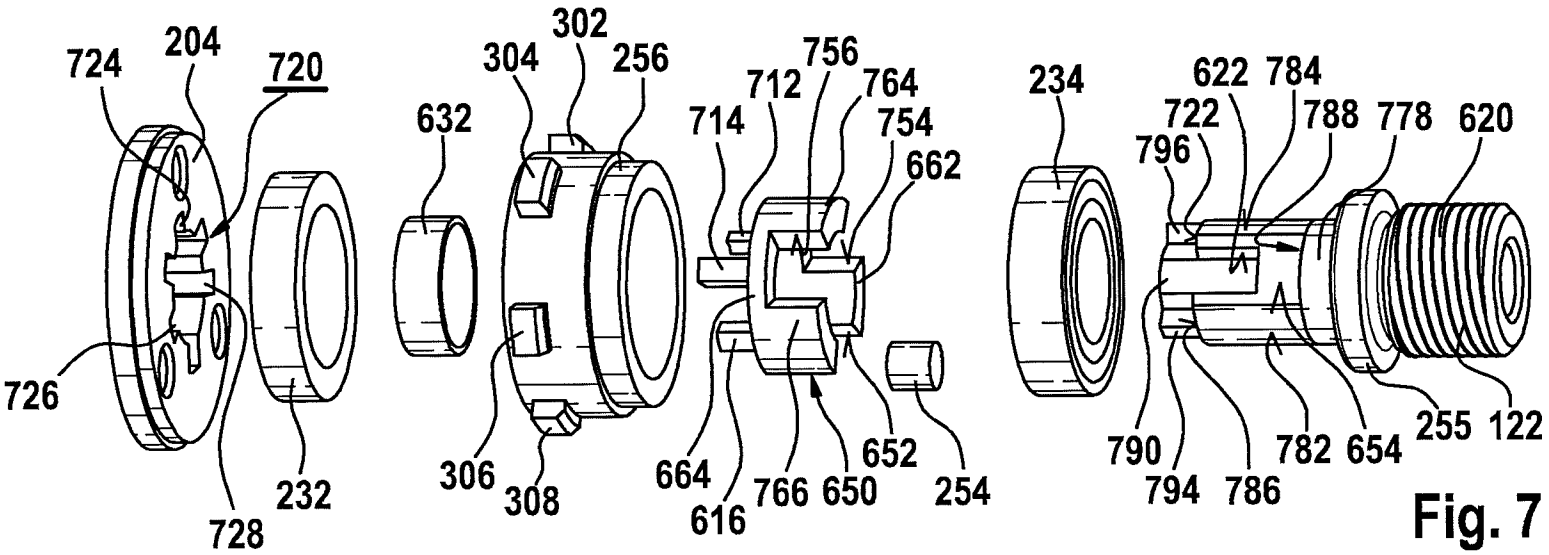
FIG. 7 is a perspective exploded depiction of the drive spindle, the drive member, the sintered bearing, the ball bearing, the bearing ring, and the spindle locking apparatus of FIG. 6.

FIG. 7 shows the assemblage of FIG. 6 without front part 210, prior to a corresponding assembly operation that occurs in a manner similar to that described with reference to FIG. 3.

Embodied on annular collar 664 of carrier element 650, according to an embodiment, are bolt-like retention member 616 and two further bolt-like retention members 712, 714, as well as axial enlargement 662 and two further axial enlargements 764, 766, which constitute recess 652 and two further recesses for the reception of spindle roller 254 and of two further spindle rollers.

Drive spindle 620 has, illustratively, a spindle body 790, directed away from bracing flange 255, on which is provided an annular bearing structure 378 for mounting ball bearing 234, said structure terminating illustratively in an annular shoulder 788. Adjacent thereto is the at least one flattened lateral surface 654 that transitions into groove-like recess 622. In addition, two lateral surfaces 782, 784 having an arc-shaped cross section are illustratively adjacent to annular shoulder 788; these transition, at a further shoulder 786, illustratively into at least one, preferably three ridges, of which two ridges 794, 796 are visible in FIG. 7.

Planet carrier 204 has in FIG. 7 a retention and entrainment apparatus 720 on which retention grooves are provided for preferably zero-clearance reception of bolt-like retention members 616, 712, 714 of carrier element 650. Said grooves correspond substantially to retention grooves 412, 414, 416 of FIG. 4, and are not labeled in FIG. 7 in the interest of graphic simplicity and clarity. Retention and entrainment apparatus 720 furthermore has entrainment grooves 724, 726, 728 for the reception of ridges 794, 796 of drive spindle 620, so that the latter can be mounted on planet carrier 204 via a positive engagement having radial clearance.

Figure 8:
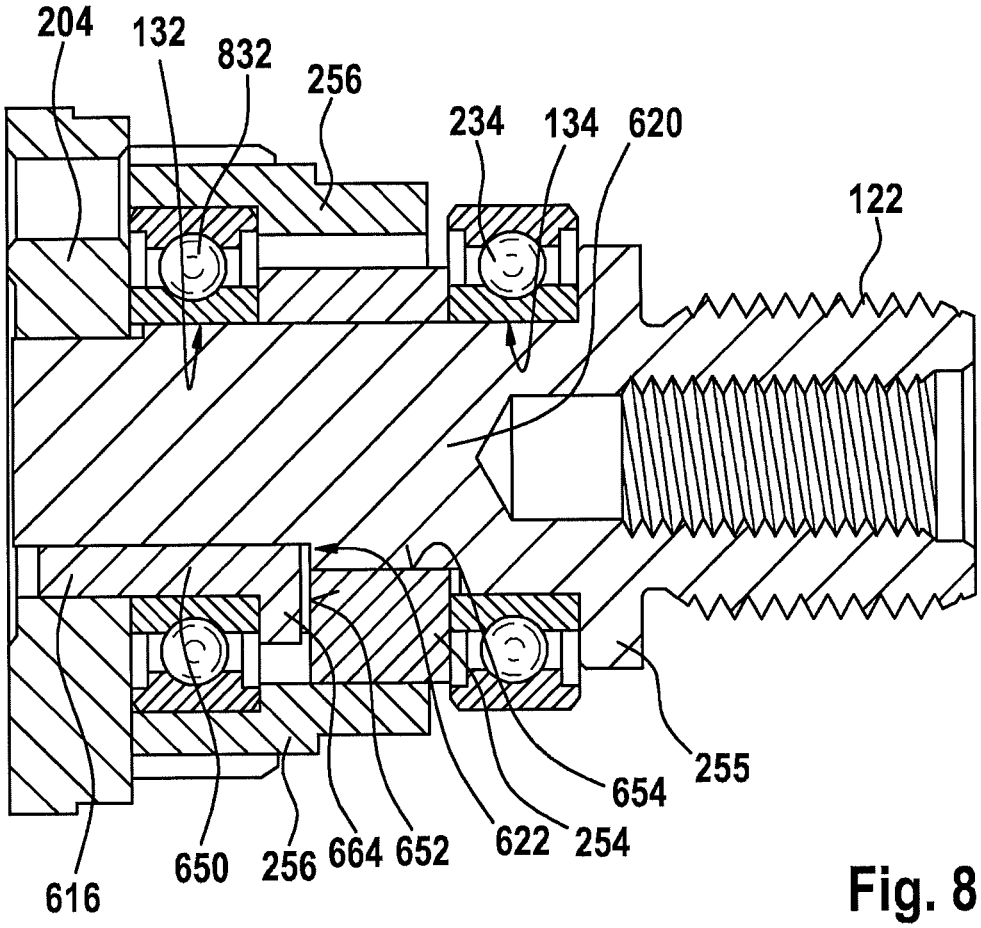
FIG. 8 is an enlarged sectioned view of the portion of the electric tool of FIG. 1, according to a third embodiment.

FIG. 8 shows the assemblage of FIG. 7 after an assembly operation in which, instead of bearing ring 632 and sintered bearing 232, a rolling bearing 832, e.g., a ball bearing, is used. The latter is pressed, like bearing ring 632 of FIG. 6, onto drive spindle 620 and carrier element 650. Ball bearing 832 is furthermore pressed into blocking member 256.

Figure 9:
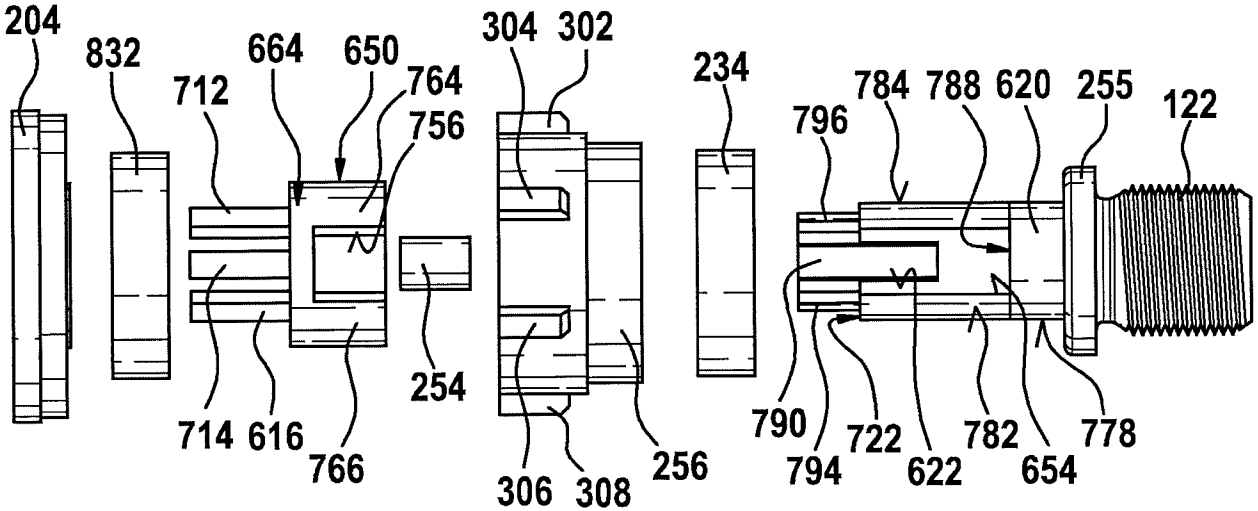
FIG. 9 is a perspective exploded depiction of the drive spindle, the drive member, the ball bearings, and the spindle locking apparatus of FIG. 8.

FIG. 9 shows the assemblage of FIG. 8 prior to assembly. FIG. 9 illustrates the use of ball bearing 832 instead of bearing ring 632 and sintered bearing 232 of FIGS. 6 and 7.

Figure 10:
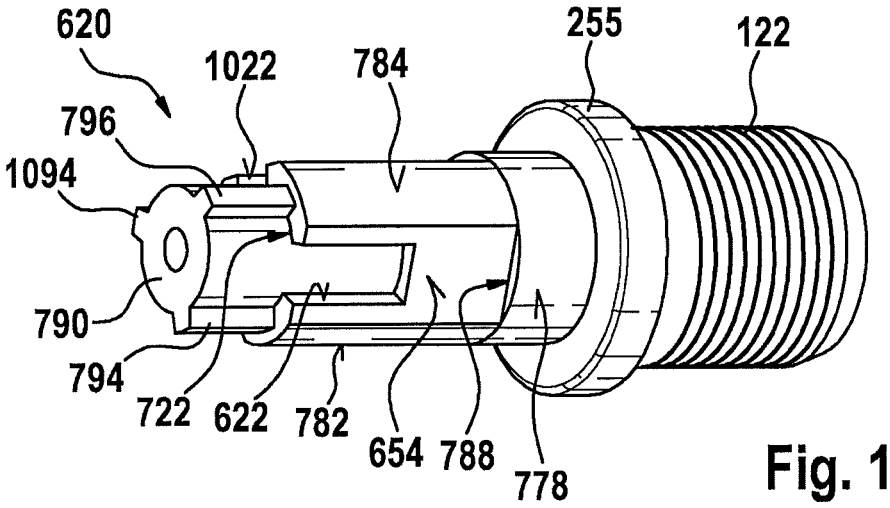
FIG. 10 is a perspective view of the drive spindle of FIG. 9.

FIG. 10 shows drive spindle 620 of FIGS. 6 to 9. A further ridge 1094 and a further recess 1022 are visible in FIG. 10.

Figure 11:
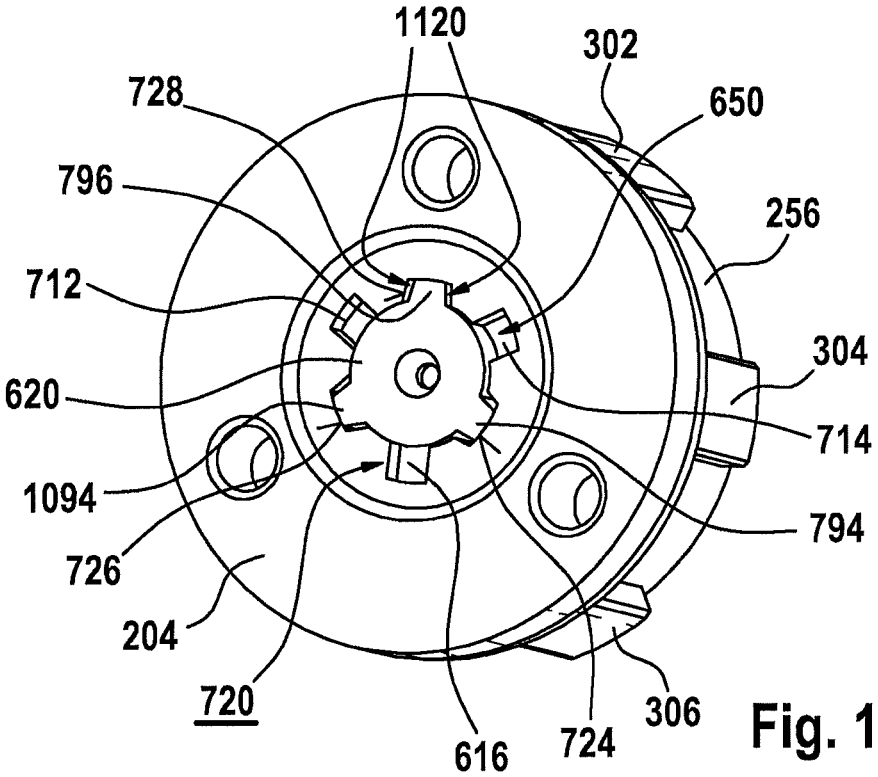
FIG. 11 is a perspective rear view of the components of FIG. 9 after assembly.

FIG. 11 is a rear view of the assemblage of FIG. 8, with carrier element 650 mounted in at least substantially zero-clearance fashion on planet carrier 204, and with drive spindle 620 likewise mounted on planet carrier 204. The spindle is mounted on planet carrier 204, as described above, by way of a positive engagement having radial clearance, so that a clearance 1120 respectively predefined within suitable tolerances (and labeled only once in FIG. 11 for the purpose of graphic simplicity and clarity) is embodied respectively between ridges 794, 796, 1094 of drive spindle 610 and entrainment grooves 724, 728, 726.

During the operation of electric tool 100 of FIG. 1, drive spindle 620 in accordance with the embodiments shown in FIGS. 2 to 11 is driven directly by way of planet carrier 204 acting as drive member. The carrier can rotate relative to drive spindle 620, but preferably not relative to carrier element 650.

Figure 12:
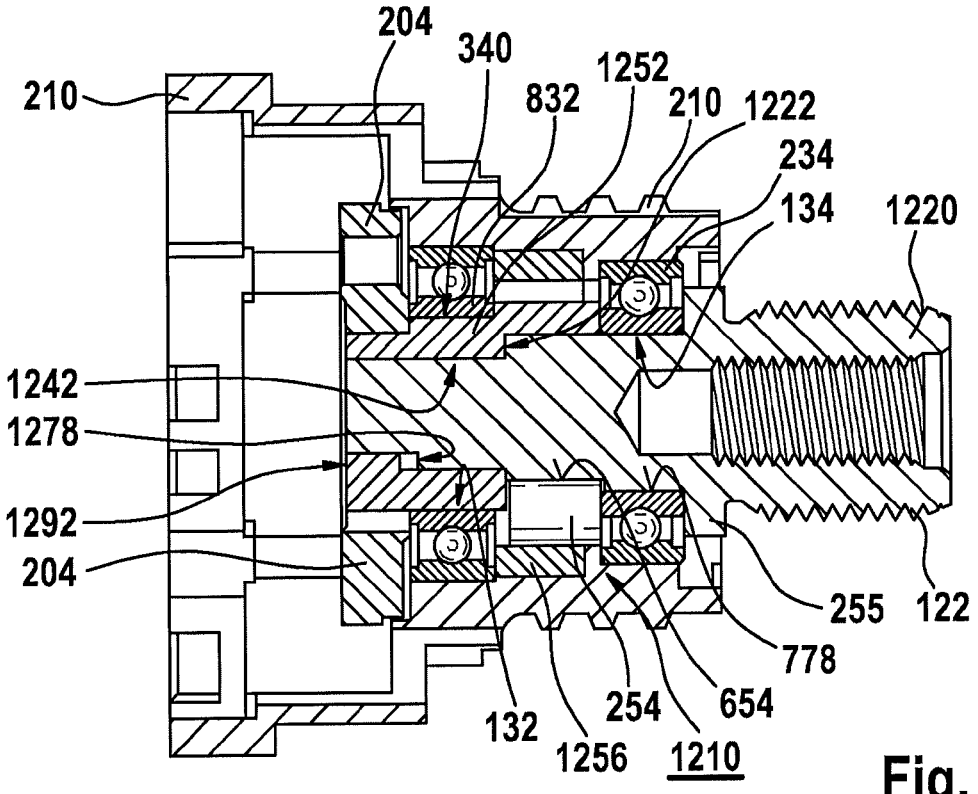
FIG. 12 is an enlarged sectioned view of the portion of the electric tool of FIG. 1, according to a fourth embodiment.

FIG. 12 shows planet carrier 204, ball bearings 832, 234 of FIG. 8, and a drive spindle 1220, as well as a blocking member 1256, a carrier element 1252, and spindle roller 254 of FIGS. 2 to 11, which are disposed in front part 210 of FIG. 2 and constitute a spindle locking apparatus 1210 in accordance with a further embodiment, in which carrier element 1252 serves as a drive member as described below with reference to FIG. 13. Blocking member 1256 is preferably embodied to be shorter as compared with blocking member 256 of FIGS. 2 to 11, so that it surrounds substantially only a region of carrier element 1252 and of drive spindle 1220 in which the at least one spindle roller 254 is disposed.

Drive spindle 1220 has, as compared with drive spindle 620 of FIGS. 6 to 11, an annular shoulder 1222 at which, proceeding from the at least one flattened lateral surface 654, drive spindle 1220 tapers, in an axial direction directed away from bracing flange 255, into an axial end region 1242 on which at least one entrainment groove 1278 is embodied. The latter serves to receive an associated entrainment ridge 1292, directed radially inward and provided on carrier element 1252 that is illustratively embodied in a sleeve shape, as described below with reference to FIG. 13.

Bearing ring 340 of FIG. 3 is provided illustratively on carrier element 1252. Pressed onto said ring is ball bearing 832, which is e.g. pressed, or molded by plastic injection, into front part 210.

Figure 13:
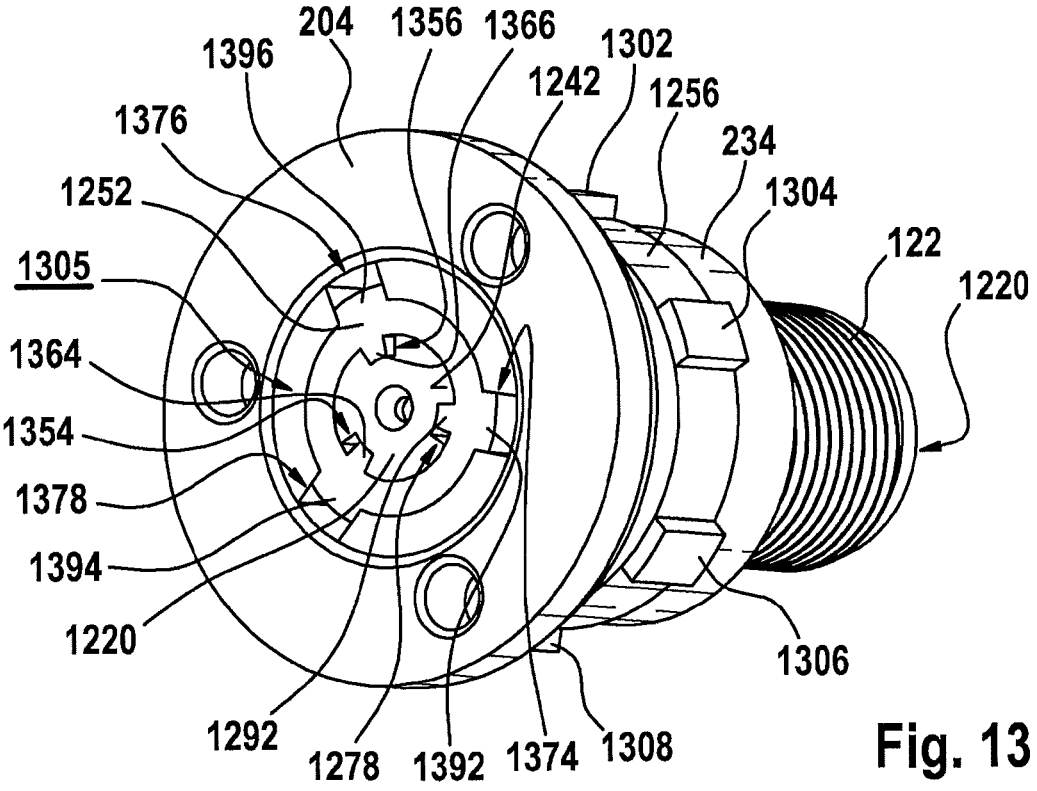
FIG. 13 is a perspective rear view of the drive spindle, the drive member, and the spindle locking apparatus of FIG. 12 after assembly.

FIG. 13 shows the assemblage of FIG. 12 without front part 210. FIG. 13 illustrates a plurality of radial projections 1302, 1303, 1306, 1308 that are provided, by way of example, on blocking member 1256.

According to an example embodiment, an axial end region 1242 of drive spindle 1220 is disposed in carrier element 1252 in order to embody a positive engagement with radial clearance between drive spindle 1220 and carrier element 1252. For this, illustratively, the radially inwardly directed entrainment ridge 1292, as well as two further radially inwardly directed entrainment ridges 1364, 1366, of carrier element 1252 engage respectively into entrainment groove 1278, and two further entrainment grooves 1354, 1356, of drive spindle 1220 with a radial clearance predefined within suitable tolerances.

A substantially zero-clearance positive engagement is embodied, for example, between carrier element 1252 and planet carrier 204, so that carrier element 1252 that is driven during the operation of planet carrier 204 serves as a drive member and directly drives drive spindle 1220. For this, radially outwardly directed entrainment ridges 1392, 1394, 1396 embodied by way of example on carrier element 1252 engage respectively into associated entrainment grooves 1374, 1378, 1376 that are associated with a retention and entrainment apparatus 1305 embodied on planet carrier 204.

Figure 14:
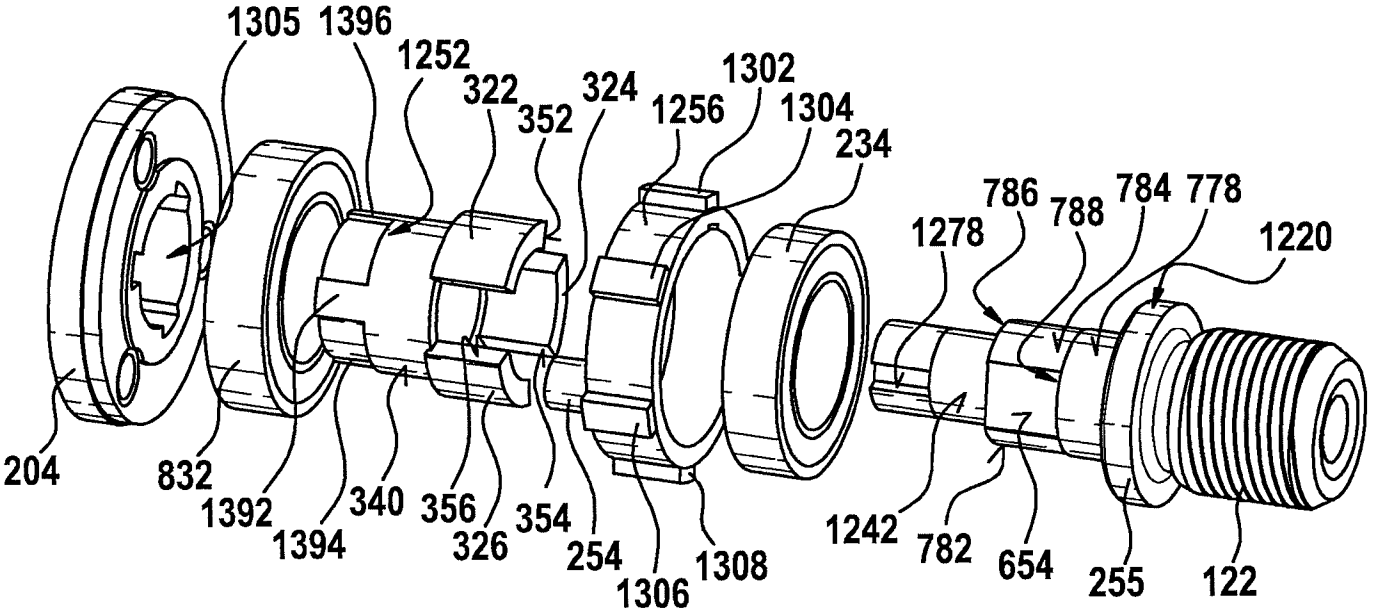
FIG. 14 is a perspective exploded depiction of the drive spindle, the drive member, the ball bearings, and the spindle locking apparatus of FIG. 12.

FIG. 14 shows the assemblage of FIG. 13 prior to corresponding assembly. FIG. 14 illustrates an exemplifying embodiment of carrier element 1252.

Figure 15:
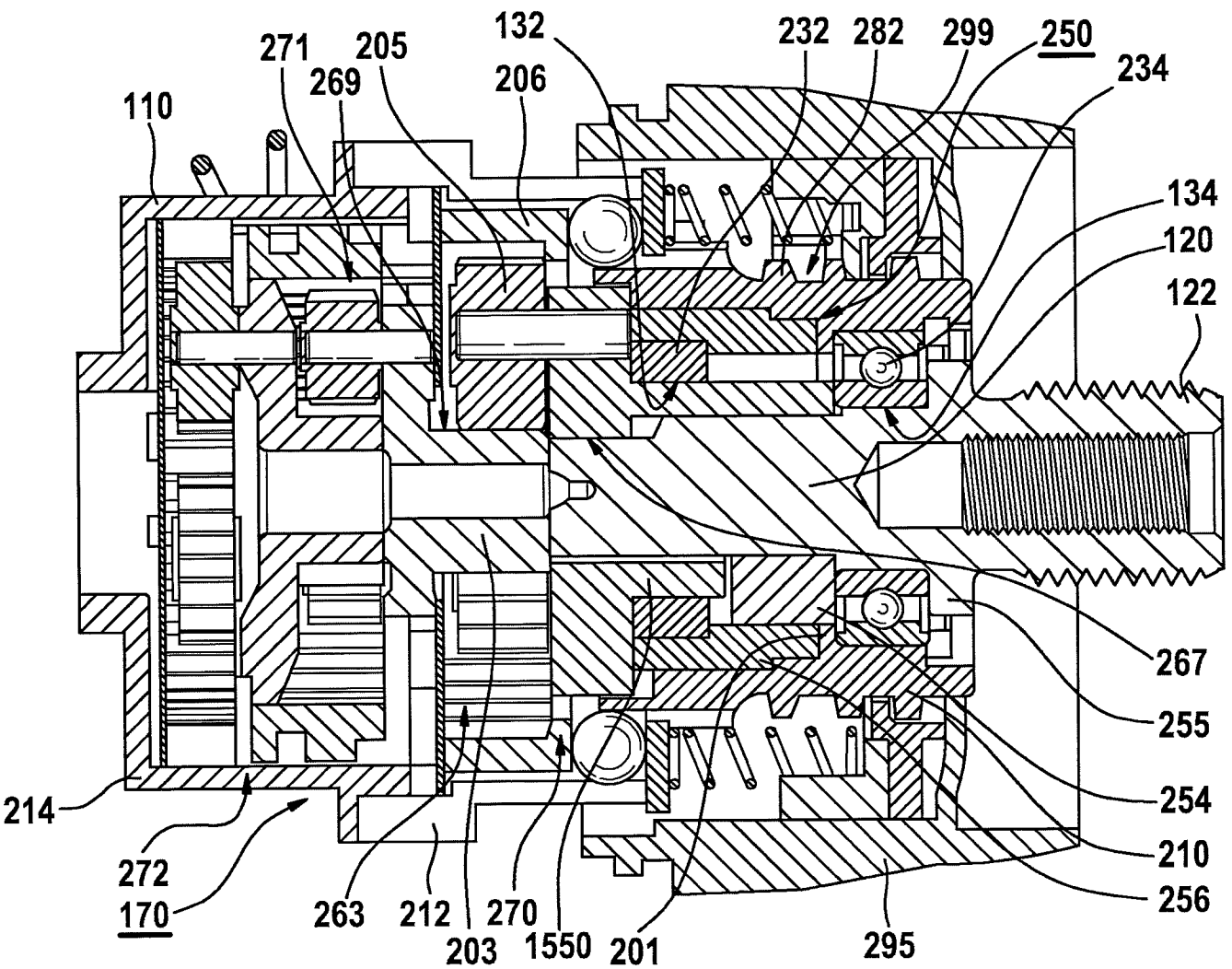
FIG. 15 is an enlarged sectioned view of the portion of the electric tool of FIG. 1, according to a fifth embodiment.

FIG. 15 shows the assemblage of FIG. 2 in accordance with an example embodiment in which planet carrier 204 and carrier element 252 of FIG. 2 are embodied, by way of example, integrally, and constitute an illustrative drive member 1550.

What is claimed is:

1. A handheld electric tool, comprising:

a tool housing in which is disposed a gearbox for transferring a torque, generated by a drive motor, to a drive spindle with which a spindle locking apparatus is associated, the drive spindle being rotatably mounted in the tool housing at at least two bearing points, wherein the entirety of the at least two bearing points are provided in the tool housing in a region downstream from the gearbox, and the spindle locking apparatus is disposed between the two bearing points in an axial direction of the drive spindle, wherein the spindle locking apparatus has a carrier element and an annular-shaped blocking member, the carrier element being mounted on the drive spindle with a predefined radial clearance, and at least one spindle roller is disposed radially between the drive spindle and the annular-shaped blocking member, wherein the at least one spindle roller abuts against the drive spindle directly between the two bearing points in an axial direction of the drive spindle.

2. The electric tool as recited in claim 1, wherein the carrier element is mounted at a first of the at least two bearing points, by way of a bearing ring embodied on an outer periphery of the carrier element, in a plain bearing.

3. The electric tool as recited in claim 2, wherein the plain bearing is mounted in a blocking member which is embodied to prevent the at least one spindle roller from sliding out of the carrier element in a radial direction of the drive spindle.

4. The electric tool as recited in claim 3, wherein the blocking member is embodied annularly and is connected nonrotatably to the tool housing.

5. The electric tool as recited in claim 1, wherein the drive spindle is mounted, at a first of the at least two bearing points, in a rolling bearing.

6. The electric tool as recited in claim 5, wherein the rolling bearing is mounted in a blocking member which is embodied to prevent the at least one spindle roller from sliding out of the carrier element in a radial direction of the drive spindle.

7. The electric tool as recited in claim 1, wherein the drive spindle is mounted, at a second of the at least two bearing points, in a rolling bearing that is mounted in the tool housing.

8. The electric tool as recited in claim 1, wherein the carrier element is of sleeve-shaped configuration and surrounds the drive spindle at least in portions, at least one recess for receiving the at least one spindle roller being embodied on the carrier element.

9. The electric tool as recited in claim 1, wherein the carrier element is connected nonrotatably to a drive member of the gearbox.

10. The electric tool as recited in claim 9, wherein the gearbox is embodied as a planetary gearbox, and the drive member is a planet carrier.

11. The electric tool as recited in claim 10, wherein the drive spindle is drivable directly by the drive member, a predefined radial clearance being embodied between the drive member and the drive spindle.

12. The electric tool as recited in claim 9, wherein the drive spindle is drivable directly by the carrier element.

13. The electric tool as recited in claim 1, wherein a bearing ring that is mounted in an associated plain bearing is nonrotatably disposed on the drive spindle in the region of a first of the at least two bearing points.

14. A handheld electric tool, comprising:

a tool housing in which is disposed a gearbox for transferring a torque generated by a drive motor to a drive spindle with which a spindle locking apparatus is associated, the drive spindle being rotatably mounted in the tool housing at at least two bearing points, wherein a brake apparatus which is embodied to prevent chattering during operation of the electric tool in the context of a runout of the drive spindle is provided on the drive spindle in the region of the spindle locking apparatus, wherein the brake apparatus has an O-ring to implement a braking function, wherein an annular groove in which the O-ring is disposed is embodied on the drive spindle in a region of the spindle locking apparatus, wherein the at least two bearing points are provided in the tool housing in a region downstream from the gearbox, and the spindle locking apparatus is disposed between the two bearing points in an axial direction of the drive spindle, wherein the spindle locking apparatus has a carrier element, wherein at least one spindle roller is disposed at the carrier element, wherein the at least one spindle roller abuts against the drive spindle directly between the two bearing points in an axial direction of the drive spindle.

15. The electric tool as recited in claim 14, wherein the carrier element is mounted on the drive spindle with a predefined radial clearance, the brake apparatus being disposed in the region of the carrier element.

16. The electric tool as recited in claim 15, wherein the carrier element is connected nonrotatably to a drive member of the gearbox.

17. The electric tool as recited in claim 16, wherein the drive spindle is drivable directly by the carrier element.

18. The electric tool as recited in claim 15, wherein the carrier element is mounted, by way of a bearing ring embodied on an outer periphery, in a plain bearing at a first of the at least two bearing points.

19. The electric tool as recited in claim 18, wherein the plain bearing is mounted in a blocking member which is embodied to prevent the at least one spindle roller from sliding out of the carrier element in a radial direction of the drive spindle.

20. The electric tool as recited in claim 14, wherein an entirety of the at least two bearing points are provided in the tool housing in a region downstream from the gearbox.

* * * * *